United States Patent [19]

Johnson et al.

[11] Patent Number: 4,812,079

[45] Date of Patent: Mar. 14, 1989

[54] EMBEDDING CABLELIKE MEMBERS

[75] Inventors: Harry Johnson; Ralph M. Ware, both of Merritt Island, Fla.

[73] Assignee: Casper Colosimo & Son, Inc., Pittsburgh, Pa.

[21] Appl. No.: 902,146

[22] Filed: Aug. 29, 1986

[51] Int. Cl.[4] ..... F16L 1/04; E02F 5/10

[52] U.S. Cl. ..... 405/164; 37/62; 405/163

[58] Field of Search ..... 405/158-165; 37/61, 62, 76, 78

[56] References Cited

U.S. PATENT DOCUMENTS

| | | | |
|---|---|---|---|
| 3,333,432 | 8/1967 | Hale et al. | 405/164 |
| 3,338,060 | 8/1967 | Harmstorf | 405/163 |
| 3,504,504 | 4/1970 | Elliott | 405/163 |
| 3,638,439 | 2/1972 | Niederer | 405/159 |

OTHER PUBLICATIONS

"Cable Plow Takes on Double Duty", ENR, Apr. 15, 1982, 3 pages.

*Primary Examiner*—David H. Corbin

*Attorney, Agent, or Firm*—Arnold B. Silverman; Suzanne Kikel

[57] ABSTRACT

An embedding apparatus for optionally cutting through different densities of soil and rock in order to embed cable in a waterbed. The apparatus comprises a low pressure jet assembly for cutting into the soil, a rock-cutting assembly with teeth for cutting into soft rock; a rock-embedment depressor with a rotary saw blade assembly for cutting into relatively harder rock; and a depth sensor device. The low pressure jet assembly is part of a pivotal soil embedment depressor and liquifies the soil without any permanent soil displacement. The rock embedment depressor is selectively attachable to the soil embedment depressor, and has jets connected to a source of pressurized fluid to provide an hydraulic cushion thereunder and to clear the rock debris for the embedment of the cable.

33 Claims, 11 Drawing Sheets

EMBEDDING CABLELIKE MEMBERS

Figure 1:
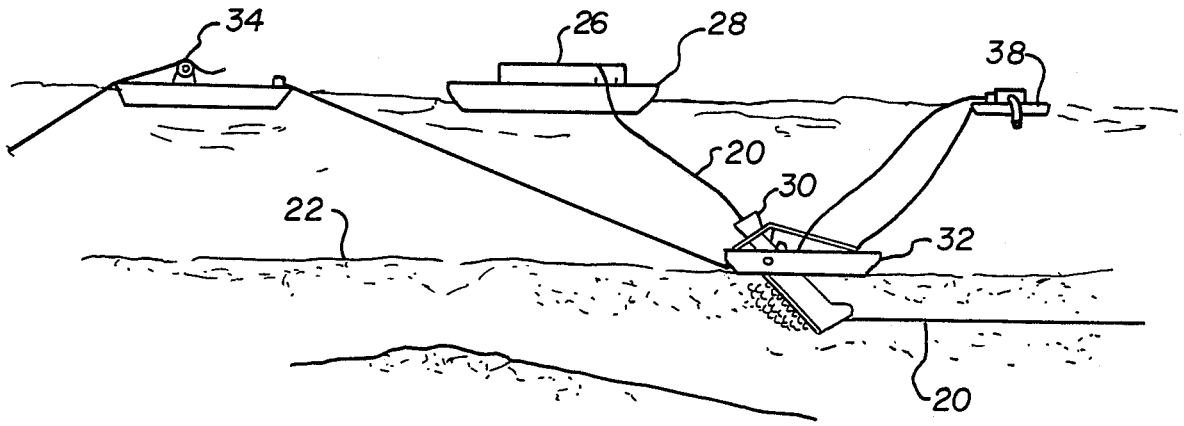

This invention relates to embedding cablelike members underwater.

A primary object of the invention is to provide for embedding cable or cablelike members, conveniently and effectively at varying desired depths beneath the bed of rivers, lakes or other bodies of water. The apparatus is lightweight, easily transportable, inexpensive, simple, energy efficient and reliable in operation under all conditions and in various combinations of water bed sand, clay, and/or rock. Other objects of the invention are to avoid damage to the cablelike member(s) (e.g. from excessively sharp bending, from crushing, from abrasion against the embedding mechanism, or from obstacles in the soil), to make possible accurate, monitored, reported and recorded depth of embedment of the cablelike member(s), to achieve this cable embedment with minimum disturbance to the marine environment (e.g. by limiting soil displacement), and to permit embedding of already laid cables, and cables with enlarged portions such as splice cases or amplifier housings in a relatively rapid manner, all with minimum of equipment peripheral to the embedding mechanism itself (e.g. frequently without highly specialized support vehicles or craft).

The invention features a rapidly loaded or unloaded adjustable-depth soil-embedment depressor assembly (being connected to a source of fluid under pressure to temporarily fluidize water bed soil in the path of the cable embedment without permanent soil displacement or turbidity), a rock-cutting assembly attachable as the rock-cutting blade of the adjustable-depth soil-embedment depressor assembly, a rock-cutting embedment depressor assembly (both rock-cutting devices being connected to various sources of fluids under pressure to drive the rock-cutting blades, reduce the fricton and binding, and to clear debris from the rock incision without substantial permanent soil displacement or turbidity), and a remote-reading sensor to report and record the depth of embedment within the water bed soils and/or rock.

In general the invention features:

- a soil-embedment depressor assembly including a low pressure jet assembly as the leading soil-cutting blade, a pair of cable guiding walls, a curved depressing plate, a member entrance bellmouth, a hydraulic ram chamber opening mechanism, and a rotating trunnion supporting structural member;
- a rock-cutting assembly including a hydraulically-driven tungsten-carbide tipped cutting assembly with supporting mounts that when attached to the low pressure jet assembly becomes the leading rock-cutting blade of the soil-embedment depressor;
- a rock-embedment depressor assembly including a hydraulically-driven tungsten-carbide tipped saw blade assembly as the leading rock-cutting blade, a pair of shoes to limit the depth of cut and to stabilize the assembly, a curved member depressor guideway and supporting structural members;
- the depressor assemblies being attached to and being the active embedment apparatus of the towed underwater cable embedment sled which has a pair of floodable pontoons generally parallel to the axis of the depressor assemblies and the axis of the cable path which support in a journal-like manner the trunnion of the soil-embedment depressor assembly for increased depth of member embedment;
- the cable embedment is towable from ashore or a floating winch station positioned in the forward path of the embeddor and is provided with jet water under pressure and hydraulic fluid under pressure from a floating pumping station;
- the remote-reading sensor accurately reports and records the depth of embedment upon a strip chart device.

Figure 2:
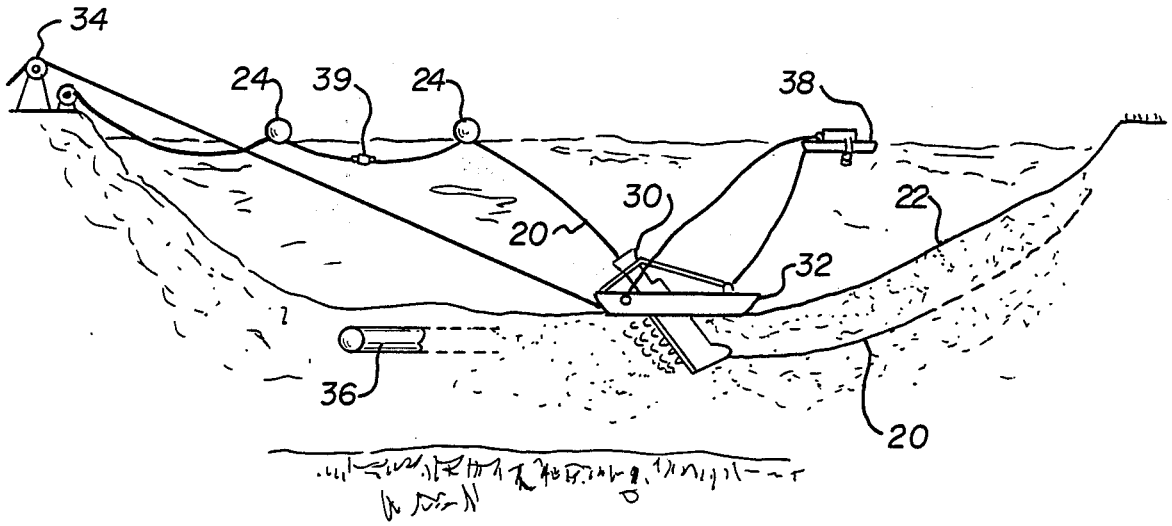
Figure 3:
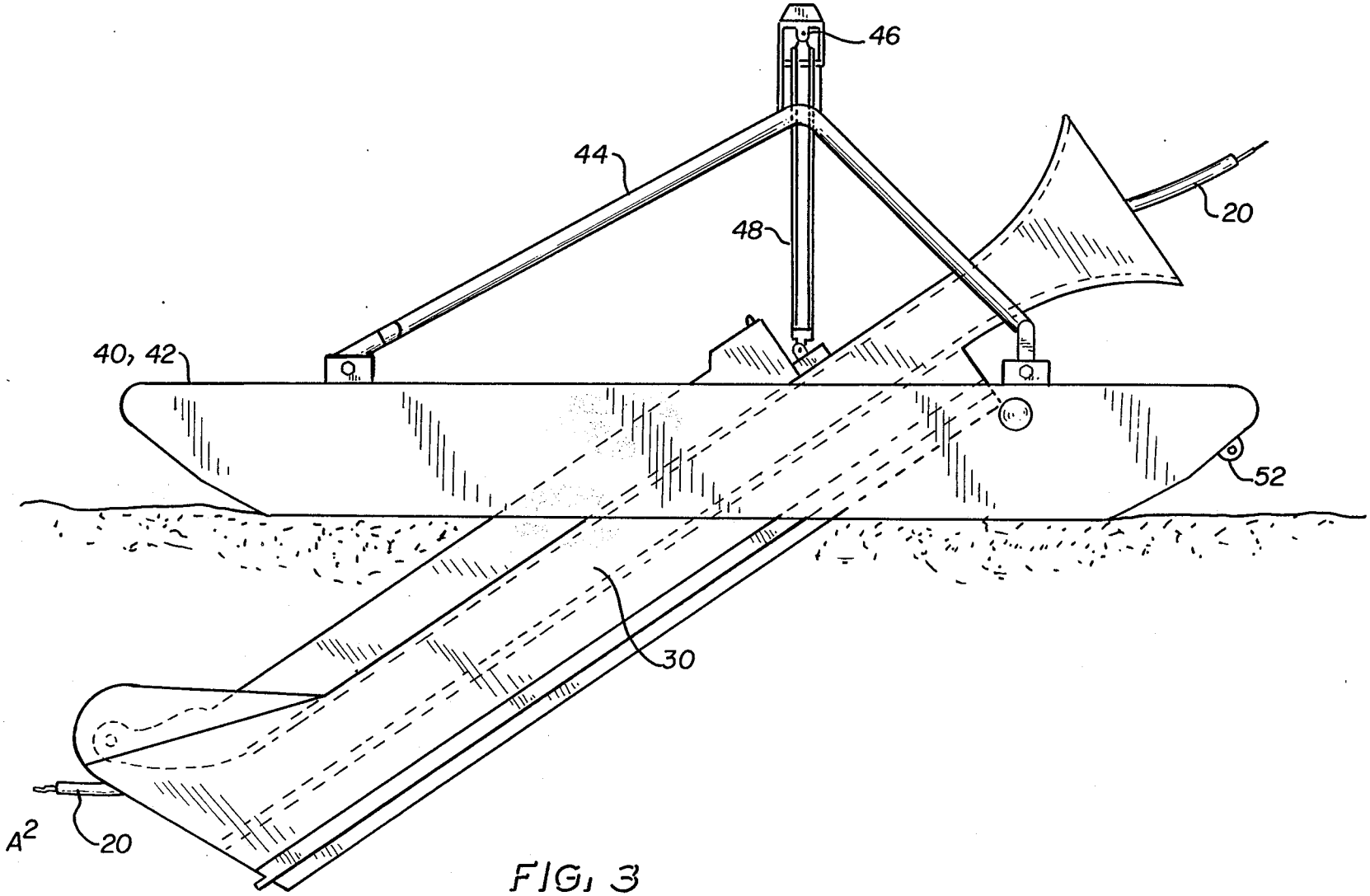
Figure 4:
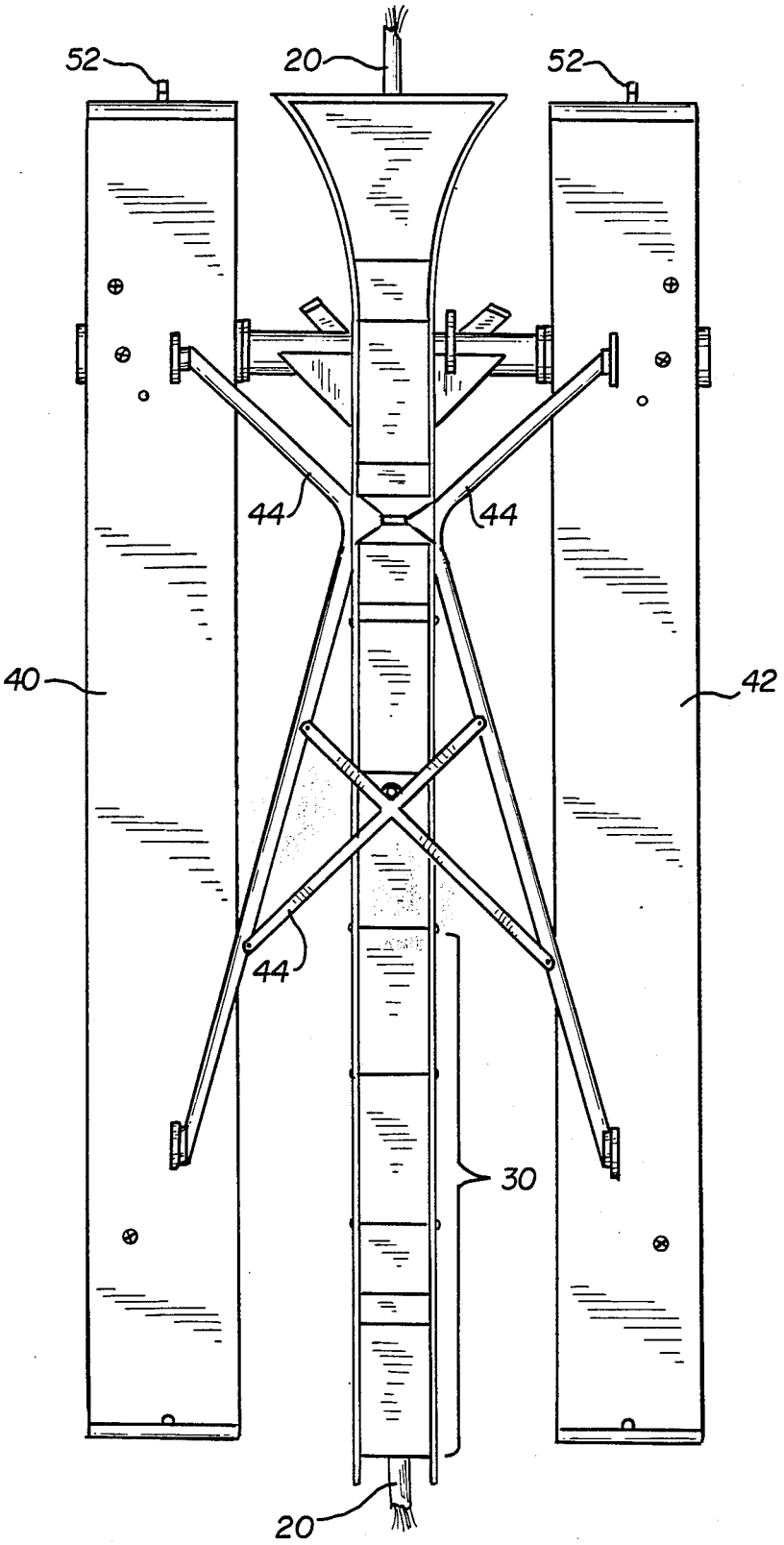
Figure 5:
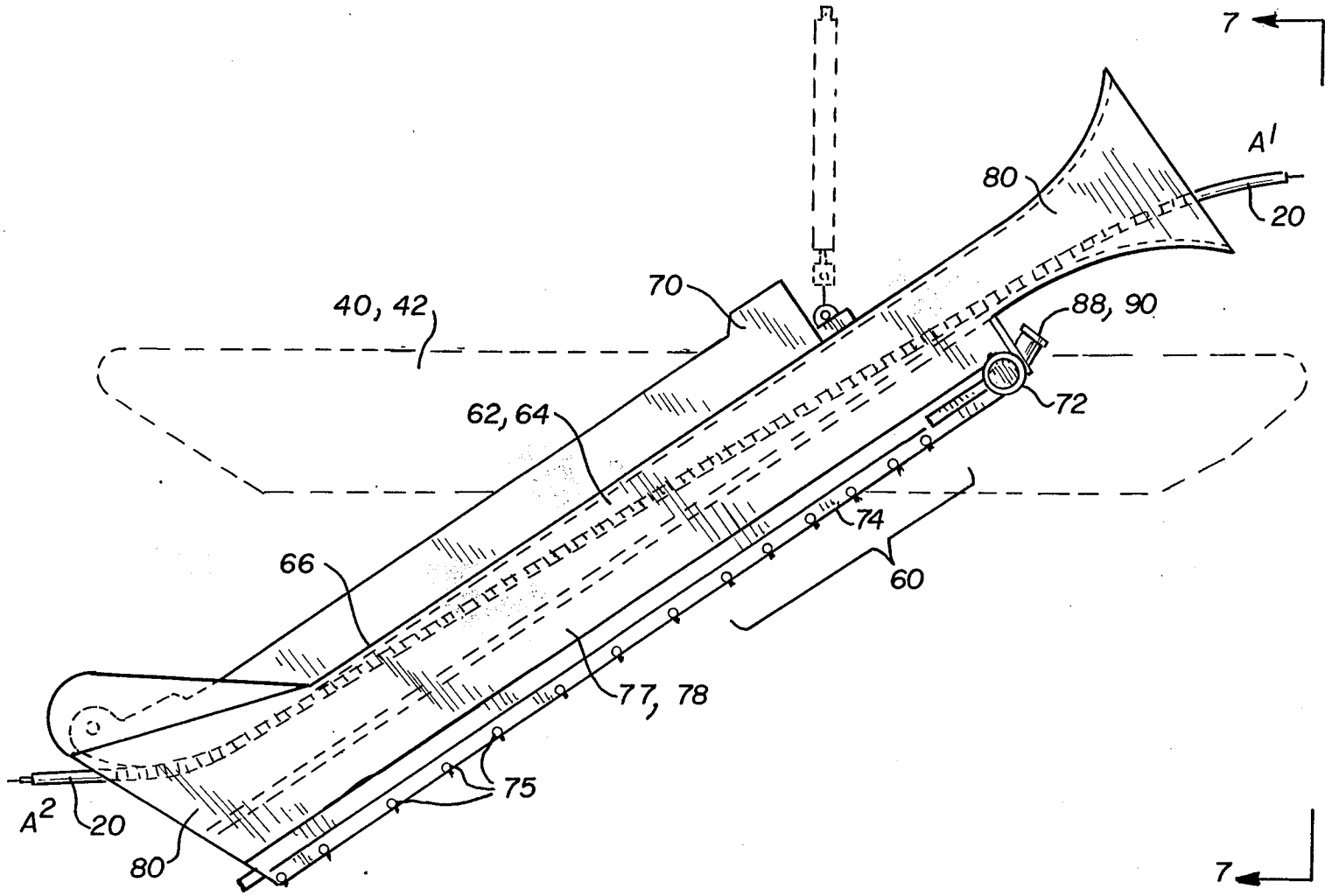
Figure 6:
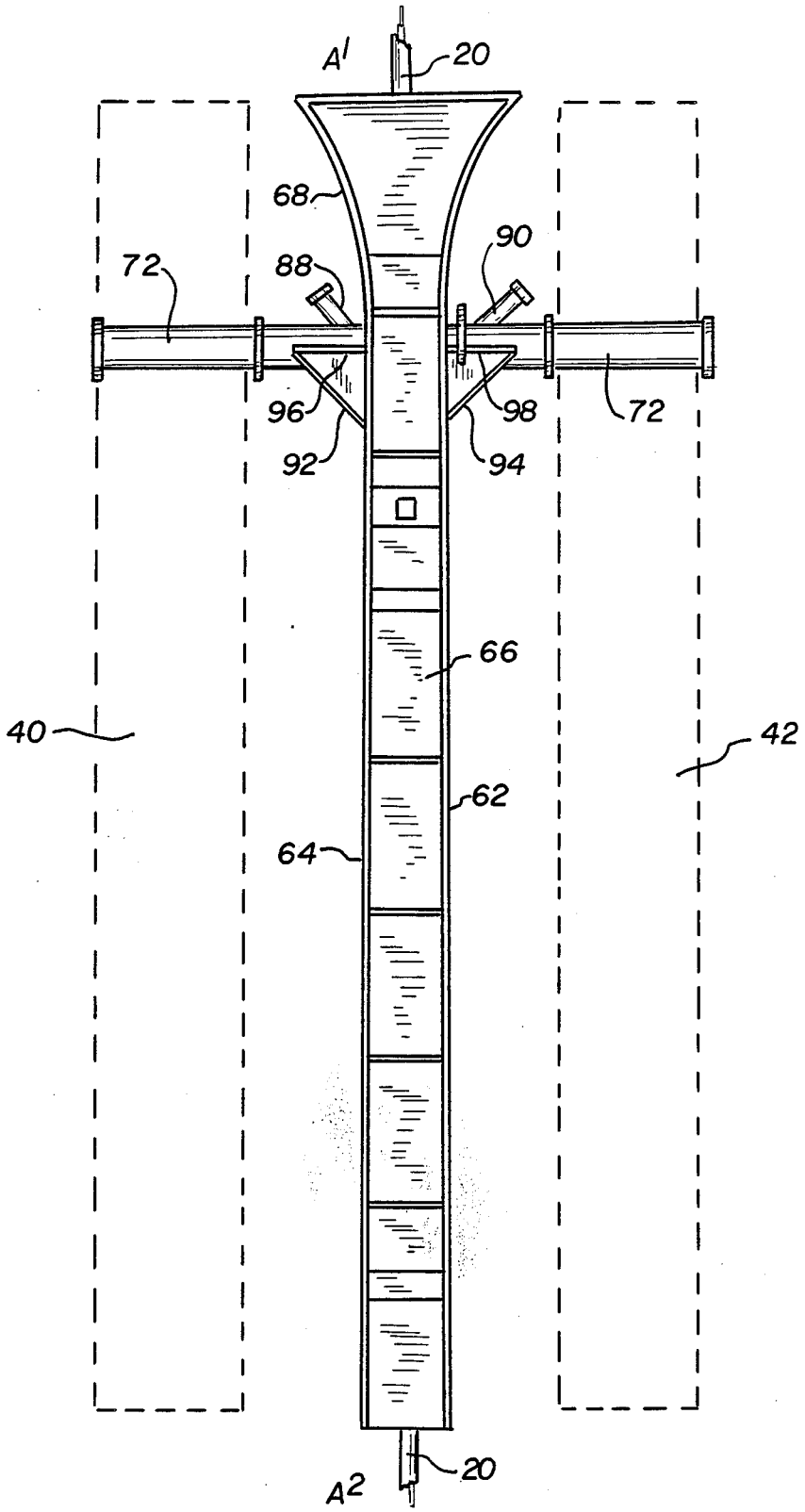
Figure 7:
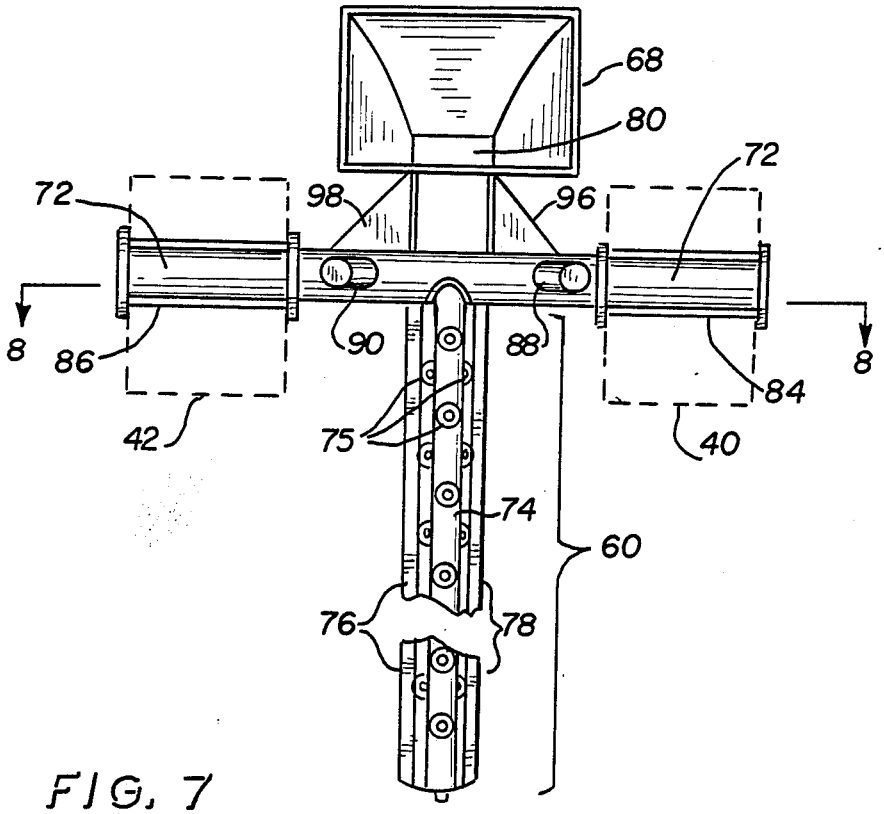
Figure 8:
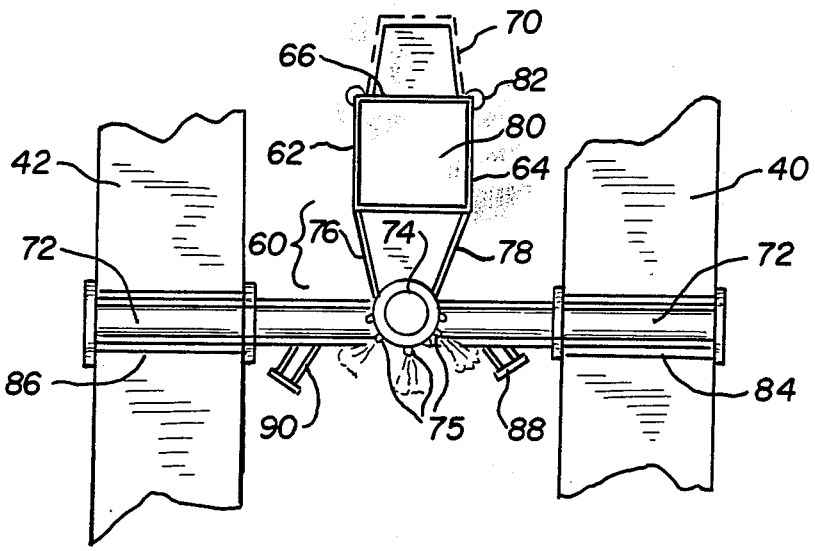
Figure 9:
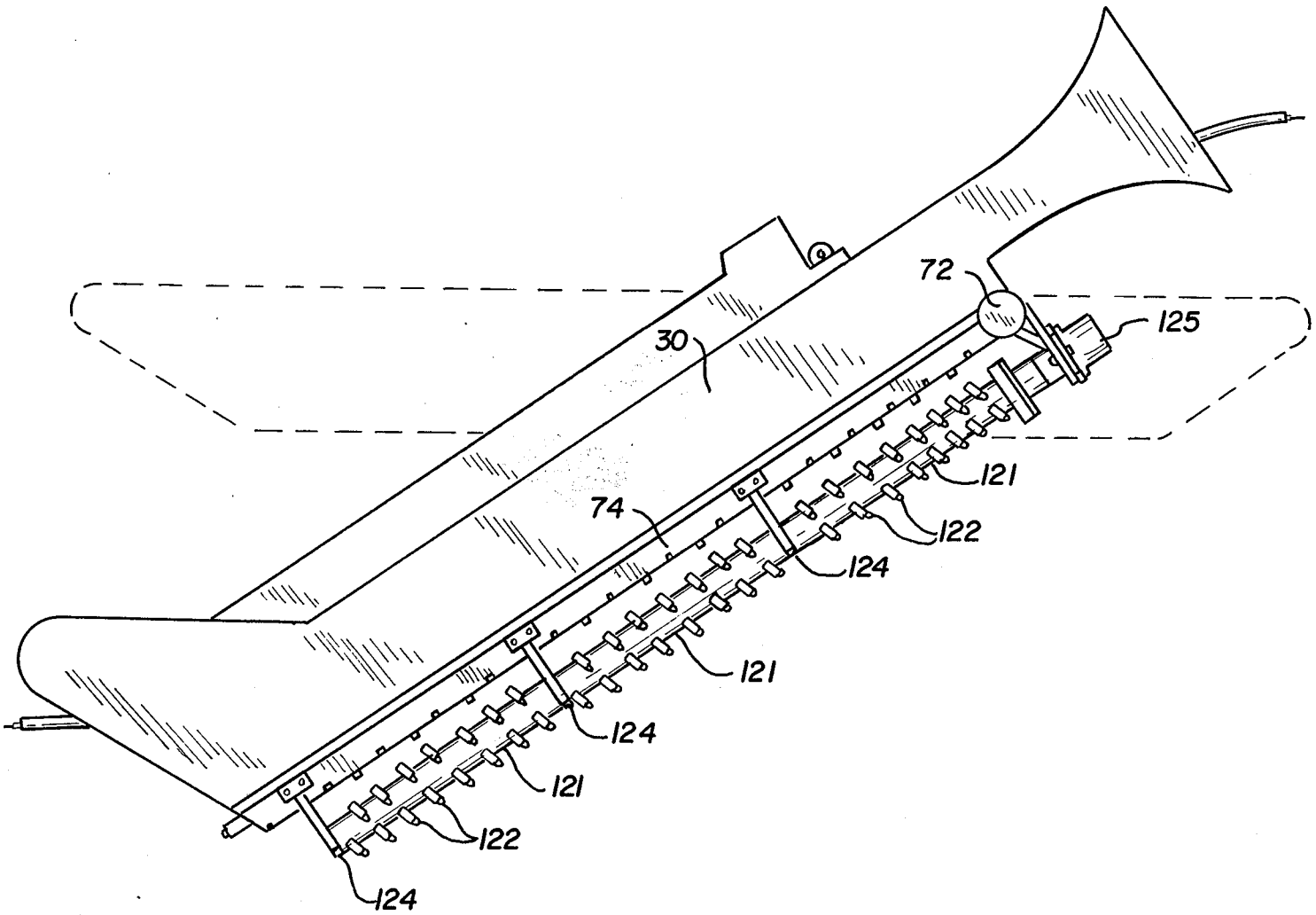
Figure 10:
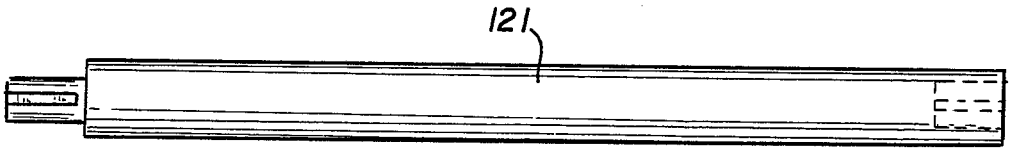
Figure 11:
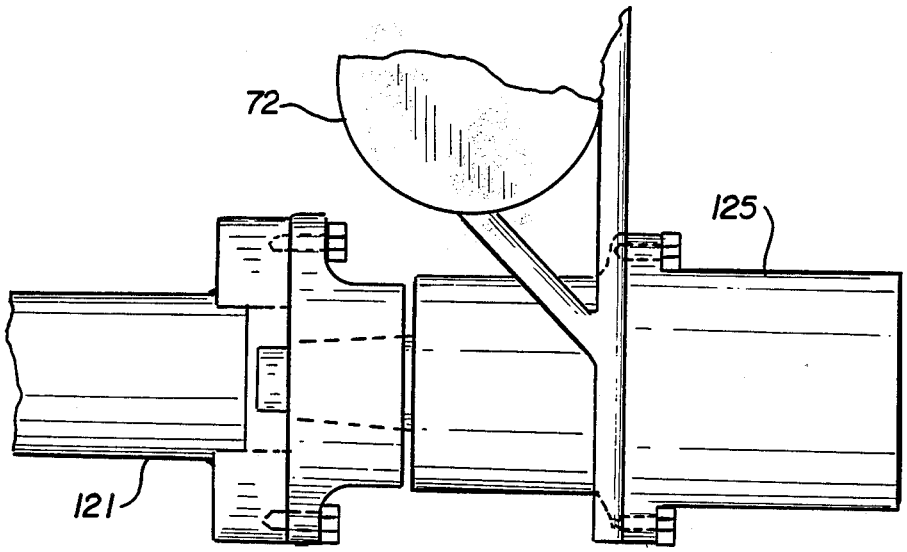
Figure 13:
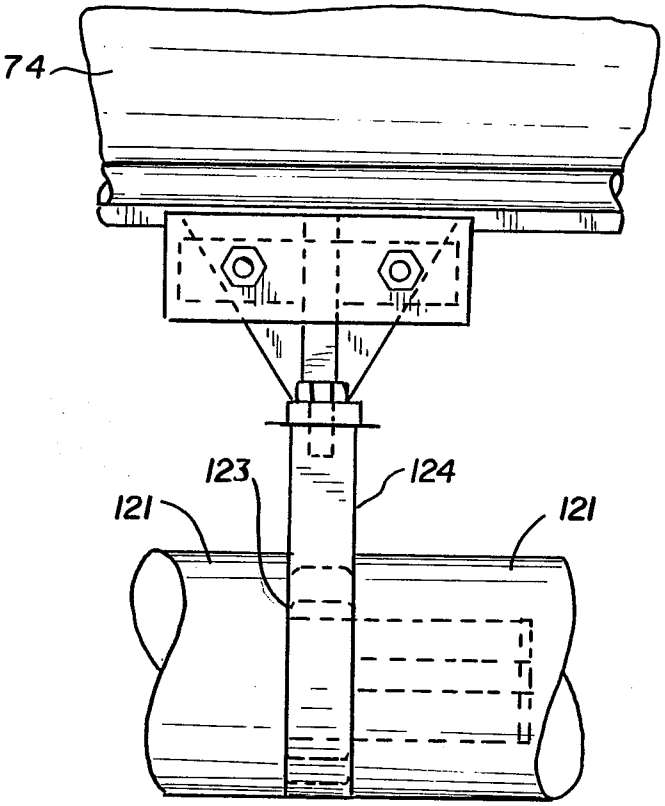
Figure 12:
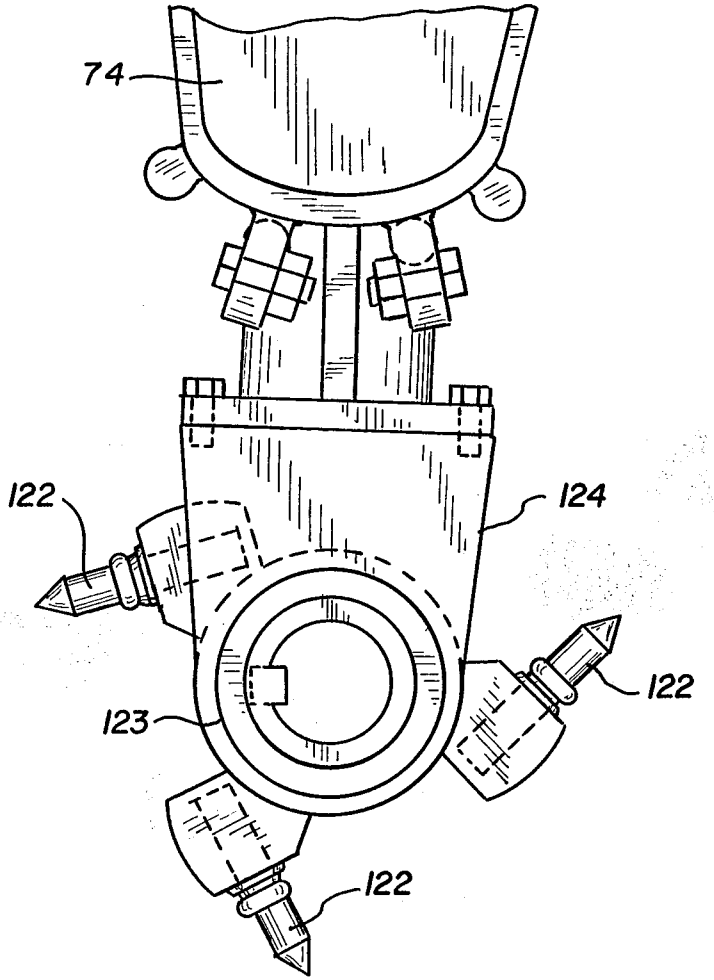
Figure 14:
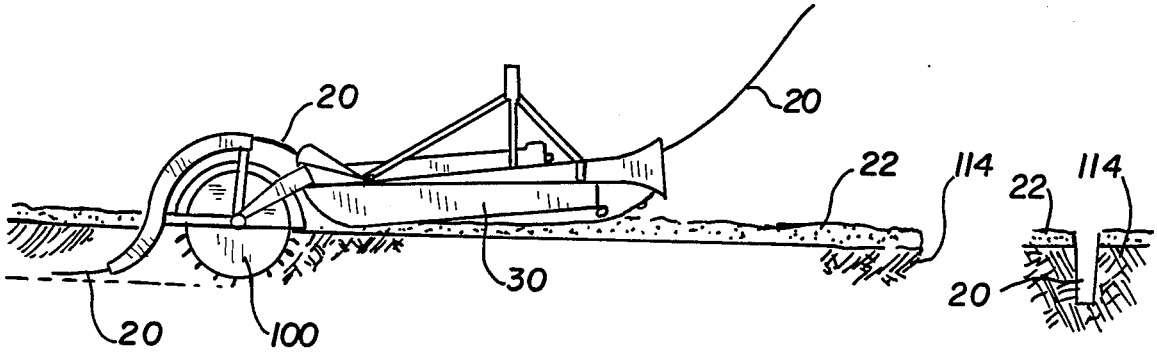
Figure 15:
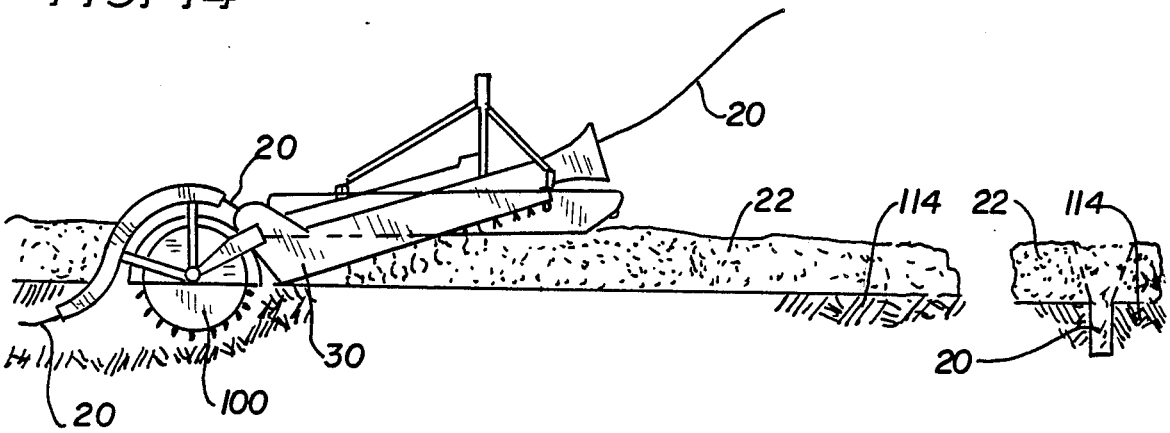
Figure 16:
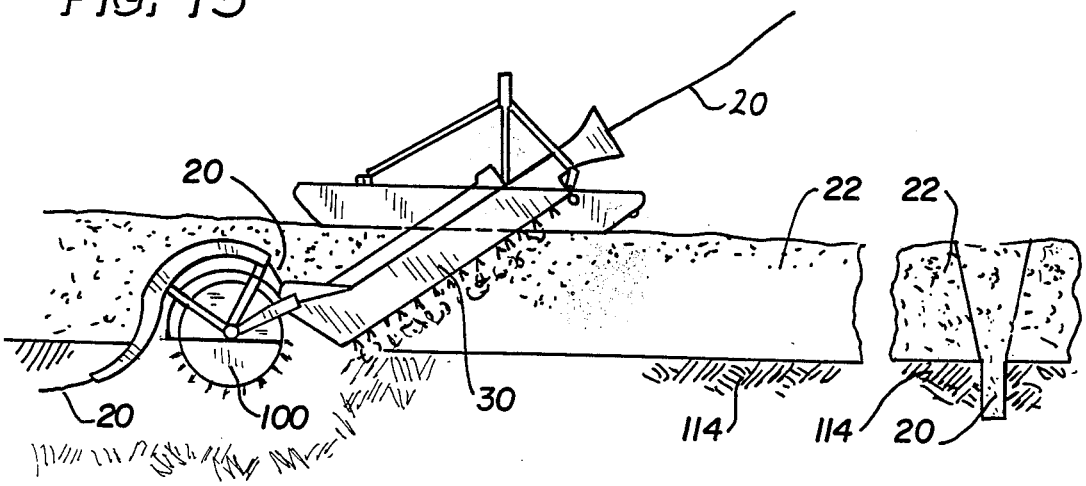
Figure 17:
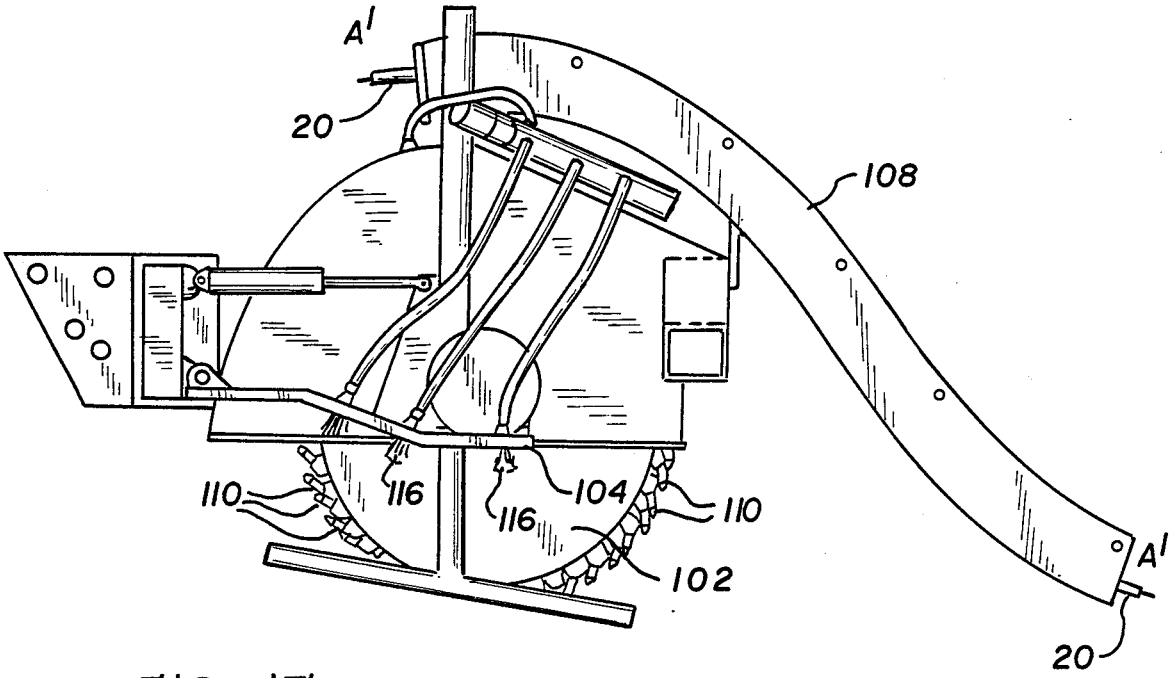
Figure 18:
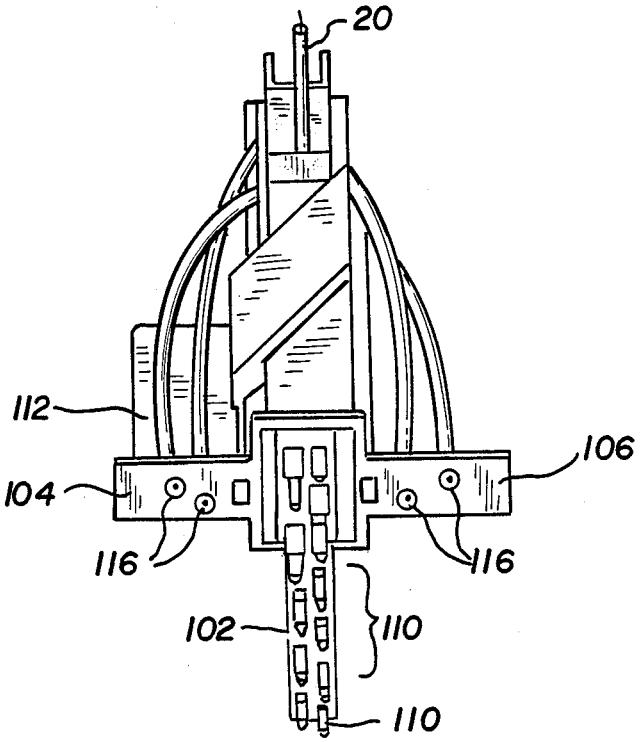

Other objects, features, and advantages will appear from the following description of the invention, taken together with attached drawings in which:

FIG. 1 is an overall diagramatic view of the cable embedment unit in operation for crossing broad expanses of water FIG. 2 is an overall diagramatic view of the cable embodiment unit in operation for crossing short expanses of water FIG. 3 is a side elevational view of the embedment unit FIG. 4 is a top plan view of the embedment unit FIG. 5 is a side elevational view of the soil-embedment depressor assembly FIG. 6 is a top plan view of the soil-embedment depressor assembly FIG. 7 is a forward elevational view of the soil-embedment depressor assembly FIG. 8 is a section taken along 8—8 of FIG. 7 through the soil-embedment depressor assembly FIG. 9 is a side elevational view of the rock-cutting assembly in position for the rock-cutting operation attached to the soil-embedment depressor assembly FIG. 10 is a side view of one of the shaft segments of the solid steel shaft of the rock-cutting assembly FIG. 11 is a side view of the hydraulic motor and motor support bracket of the rock cutting assembly FIG. 12 is a section taken through a support of the rock-cutting assembly FIG. 13 is a side view of one of the supports of the rock-cutting assembly FIG. 14 is a diagramatic view of the embedment unit with the rock-embedment depressor assembly in operation embedding cable in rock with little water bed soil overburden FIG. 15 is a diagramatic view of the embedment unit with the rock-cutting embedment depressor assembly in operation embedding cable in rock with moderate water bed soil overburden FIG. 16 is a diagramatic view of the embedment unit with the rock-embedment depressor assembly in operation embedding cable in rock with a substantial water bed soil overburden FIG. 17 is a side elevational view of the rock-embedment depressor assembly FIG. 18 is a forward underneath view of the rock-embedment depressor assembly Referring to the drawings:

The cable 20 (FIG. 1–2) to be buried in the water bed soil 22 is either extended out full length and supported by floats over the desired cable run or is fed from cable reels or pans 26 carried on a surface vessel 28, is passed through the soil-embedment depressor assembly 30 which is suppported by the embeddor sled 32 which is beig towed along the desired cable run path by winches 34 ashore or afloat, and is embedded safely in the water bed soil 22 at depths which are adjusted for purposes such as known obstructions 36.

Surface craft 38 carries pumps as source of jet water and hydraulic fluids under pressure to the soil-embedment depressor assembly.

The embeddor sled 32 (FIG. 3–4) has two floodable pontoons 40,42 spanned by a gantry framework 44 which provides a pin connection 46 for a hydraulic ram 48 which causes angular movement of the soil-embedment depressor assembly 50 in the vertical plane of the cable run path A1–A2, to increase and decrease the angle of attack of depressor assembly 30 and the depth of embedment of cable 20.

The floodable pontoons 40,42 have raked leading and trailing ends and are equipped with towing pad eyes 52 to facilitate towing along the path of the cable run. The gantry framework 44 keeps the axis of the floodable pontoons 40,42 parallel to the axis of the path of the intended cable run and establishes with the pontoons 40,42 a rigid embeddor sled assembly 32 for the support and positioning of the soil-embedment depressor assembly 30.

The major components of the soil-embedment depressor assembly 30 (FIG. 5–8) ar ea low pressure water jet assembly 60 as a leading cutting blade, a pair of cable guiding walls 62,64, a curved depressing plate 66, a member entrance bellmouth 68, a hydraulic ram chamber opening mechanism 70, and a rotating trunnion supporting structural assembly 72.

The low pressure water jet assembly 60 is a downwardly directed pipe manifold 74 fitted with three nozzles 75 that are directed into the intended forward path of the cable embedment for the purpose of liquefying the water bed soils and reducing the friction for forward movement of the jet assembly 60 which acts as an eliptical shaped soil-cutting blade made up of the jet pipe manifold 74 and welded side plates 76,78.

The cable 20 to be embedded is provided a safe downward passage within the chamber 80. During the towed forward movement of the depressor 30, the jet assembly liquefies the soil bed with water under pressure and parts the soil with its eliptical shape. The cable enters the member bellmouth 68 at A1 and is protected and confined in its travel downward through the chamber 80 which is defined by the jet assembly 60 being on the leading underside, the cable guide walls 62,64, and the depressing plate 66. The towed, forward movement of the depressor assembly 30 angles depressing plate 66 against cable 20 and guides it downward until it emerges safely embedded at a depth and position of A2. The water contained in the chamber protects the cable from any abrasion.

The hydraulic mechanism and hinges 82 enables depressing plate 66 to rapidly open and close for the purpose of accommodating cable splice cases 39 (FIG. 2) or amplifier housings which exceed the dimensions of the chamber 80. These cases or housings are manually jetted in to the water bed soil. Accordingly, at these points in the cable 20, the cable must be unloaded and reloaded in to the chamber 80 of the depressor assembly 30 by a diver.

The primary support member of the soil-embedment assembly is the trunnion assembly 72 which is fitted into trunnion blocks 84,86 mounted in pontoons 40,42 of the sled 32. The trunnion assembly is fitted with hose connectons 88,90 for pressurizing the jet assembly 60 to which it is hydraulically connected. The trunnion assembly 72 includes gusset plates 92,94,96,98 for rigidity and stability of the entire soil-depressor assembly 30.

When the cable 20 is to be deeply embedded in water bed bottoms that contain obstructions such as stiff clays, shale, soft limestone or debris, the rock-cutting assembly 120 (FIG. 9) may be attached to the soil-embedment depressor assembly 30 to cut an incision the width and depth of the soil-embedment depressor assembly 30 through the obstructions. The major components of the rock-cutting assembly 120 are three segmented solid steel shafts 121 (FIG. 10) mounted by many closely spaced tungsten-carbide tipped teeth 122 (FIG. 12) in a spiral about the shaft 121. The shaft is supported by sealed bearings 123 (FIG. 12,13) at three structural supports 124 (FIG. 12,13). The obstructions are reduced to particles by the teeth 122 being driven by a powerful hydraulic motor 125 (FIG. 11).

The major components of the rock-embedment depressor assembly 100 (FIG. 14–18) are a hydraulically driven tungsten-carbide tipped saw blade assembly 102, a pair of water jet lubricated shoes 104,106 and a curved depressor guideway 108 for the safe passage of the cable 20.

The rock embedment depressor assembly 100 is attached as an extension of the adjustable-depth soil-embedment depressor assembly 30 when encountering rock 114 in the water bed soil 22.

The rock saw cutting blade assembly 102 is fitted with replaceable tungsten-carbide teeth 110, is driven by a hydraulic power unit 112, and is kept clear of rock debris by internally positioned water jet nozzles similar to nozzles 116 mounted on shoes 104,106, to reduce friction in the forward movement of the rock-embedment depressor assembly 100.

What is claimed is:

1. Apparatus for embedding a cable-like member under the bed of a body of water, comprising an underwater cable embeddor comprising the following inventive improvements:

a rapidly loaded or unloaded adjustable-depth soil-embedment depressor assembly comprising:

a low pressure jet assembly attached as the water bed soil cutting blade of said adjustable-depth soil-embedment depressor assembly connected to a source of fluid under pressure for creating a jet flow at a flow rate sufficiently high and a pressure sufficiently low to temporarily liquefy water bed soils in the path of said cable-like member without substantial permanent soil displacement or turbidity, a rock-cutting assembly attachable to said soil embedment depressor assembly and having teeth and connected to a source of fluid water under pressure providing hydraulic power to a hydraulic motor which drives said teeth of said rock-cutting device to provide an incision in relatively soft rock for the safe embedment of said member in the incision, a rock-embedment depressor assembly selectively attachable to said soil embedment depressor assembly and including a hydraulically driven rotary tungsten-carbide tipped saw blade assembly attachable as the water bed rock-cutting extension of said adjustable-depth soil-embedment depressor assembly, said rock-embedment depressor assembly adapted to cut into rock relatively harder than said soft rock of said incision and connected to a source of fluid under pressure providing a hydraulic cushion under said rock-embedment depressor assembly and providing a hydraulic stream to constantly clear rock debris from the incision in the water bed rock for the full and safe embedment of said cable-like member in the rock incision, and a remote-reading sensor to report and record the depth of embedment within the water bed soils and/or rock.

2. The apparatus of claim 1 wherein said soil-embedment depressor assembly is defined by a low pressure jet assembly as the leading cutting blade, and consists of a pair of cable-guiding walls, a curved depressing plate, a member entrance bellmouth, and rotating trunnion supporting structural supporting members.

3. The apparatus of claim 1 wherein said low pressure jet assembly includes an eliptically shaped water bed soil cutting blade fitted with several replaceable hydraulic jet nozzles and obstruction-protection plates for the nozzles.

4. The apparatus of claim 3 wherein said nozzles are arranged in three planes relative to the plane of the cutting blade and the soil-embedment depressor.

5. The apparatus of claim 3 wherein said nozzles are arranged in the plane of the cutting blade, in a plane forty-five degrees to the right of the plane of the cutting blade, and in a plane forty-five degrees to the left of the plane and axis of the cutting blade.

6. The apparatus of claim 3 wherein said nozzles are arranged in axes which are normal to the axis of the cutting blade of the jet assembly.

7. The apparatus of claim 1 wherein said low pressure jet assembly may be provided with a flow rate of as little as 1800 gallons per minute and said pressure may be as little as 80 p.s.i above the pressure of the depth of water in which embedment is 8. The apparatus of claim 7 wherein efficient and economic member embedment rates can be achieved in cohesionless water bed soil with said flow rates and pressure.

9. The apparatus of claim 1 wherein said soil-embedment depressor may be adjusted by an hydraulic ram to varying attack angles of said jet assembly for highest cutting efficiency and/or varying soil depth, soil cohesiveness and resistance, and desired depth of embedment.

10. The apparatus of claim 2 wherein said soil-embedment depressor is adapted to be rapidly loaded or unloaded with said cable-like member by unlatching and adjusting said curved depressing plate by an hydraulic ram to expose said chamber of said soil-embedment depressor.

11. The apparatus of claim 2 wherein said chamber of soil-embedment depressor being a downward passage for said cable-like member for said embedment of said cable-like member beneath said waterbed soils.

12. The apparatus of claim 1 wherein said rock-cutting assembly is defined by a hydraulically-driven shaft having tungsten-carbide tipped teeth and mounted to cooperate with said soil cutting blade of said soil-embedment depressor.

13. The apparatus of claim 12 wherein said tungsten-carbide tipped teeth are closely mounted about a four inch diameter shaft in a six inch pitch spiral with teeth mounted every 110 degrees.

14. The apparatus of claim 12 wherein said tungsten-carbide tipped teeth are mounted so as to rotate in a circle of a diameter greater than the width of the cable guiding walls of said embedding apparatus.

15. The apparatus of claim 12 wherein said hydraulic motor rotates a four inch diameter shaft supporting said tungsten carbide tipped teeth with such power and speed sufficient to reduce softer bedrock, shales, stiff clay and other bottom obstruction into small particles.

16. The apparatus of claim 12 wherein said rock-cutting assembly is attachable to the end of said soil embedment depressor assembly.

17. The apparatus of claim 1 wherein said rock-cutting assembly is adapted to cooperate with said soil-embedment depressor assembly to enable the safe embedment of said cable-like member within the incision in the soft rock or other hard water bottom conditions within the full capability of depth of said adjustable-depth soil-embedment depressor assembly.

18. The apparatus of claim 1 wherein said hydraulically-driven tungsten-carbide tipped saw blade assembly of said rock embeddor depressor assembly acts as the leading cutting blade, and wherein said rock embeddor depressor assembly further includes a pair of shoes to limit the depth of cut and to stabilize the assembly, a curved member depressor guideway, and supporting structural members.

19. The apparatus of claim 18 wherein said shoes comprise a pair of runners extending below the drive shaft of said saw blade and generally parallel to the water bed to limit the depth of rock cut to efficient depths.

20. The apparatus of claim 18 wherein said shoes are mounted on each side of said saw blade assembly to stabilize said rock-embedment depressor assembly.

21. The apparatus of claim 18 wherein low pressure jet nozzles are mounted to the lower surface of said shoes to provide said hydraulic cushion to reduce friction and increase efficiency in advancing said rock-embedment depressor assembly.

22. The apparatus of claim 18 wherein low pressure jet nozzles are mounted to said saw blade assembly to provide said hydraulic stream to constantly clear rock debris f rom the incision in the water bed rock for the full and safe embedment of said member in the rock incision.

23. The apparatus of claim 18 wherein low pressure jet nozzles are mounted to said saw blade assembly to provide said hydraulic stream to constantly clear rock debris from said saw blade assembly.

24. The apparatus of claim 18 wherein said low pressure jet nozzles are provided with a flow rate of at least 80 psi above the pressure of the depth of water in which cable-like member embedment is to be achieved.

25. The apparatus of claim 18 wherein said curved member depressor guideway serves as a safe passage for said cable-like member over said saw blade assembly and downward for safe embedment within the rock incision.

26. The apparatus of claim 18 wherein said rock-embedment depressor assembly is attached as the water bed rock-cutting extension of said adjustable-depth soil-embedment depressor assembly.

27. The apparatus of claim 1 wherein said rock-embedment depressor assembly cooperates with said soil-embedment depressor assembly to enable the safe embedment of said cable-like member within the rock incision despite water bed soil overburdens within the capability of said adjustable-depth soil-embedment depressor assembly.

28. The apparatus of claim 1 wherein said embedding apparatus further comprises an hydraulic ram for raising and lowering said soil-embedment depressor assembly, and wherein said remote reading sensor uses the mechanical movement of said hydraulic ram to varying attack angles of said jet assembly and varying depths of embedment to originate a signal to a remote reporting and recording device above the surface of the water to record the depth of embedment.

29. The apparatus of claim 1 wherein said remote reading sensor uses the hydraulic pressure of the operating depth of water to originate a signal to a remote reporting and recording device above the surface of the water to record the depth of the underwater cable embeddor.

30. The apparatus of claim 1 wherein said cable embedoor is defined by a towed sled of two floodable pontoons and a gantry framework to which said soil embedment depressor assembly is attached.

31. The apparatus of claim 30 wherein said soil embedment depressor assembly is raised and lowered by an hydraulic ram attached to said gantry framework, wherein said upper and leading end of said soil embedment depressor is held and rotated between said pontoons by a trunnion of said depressor, and wherein said soil depressor assembly is adapted to be forced down with said rock-cutting assembly if certain softer obstructions are anticipated.

32. The apparatus of claim 1 wherein said soil-embedment depressor assembly further comprises: an hydraulic ram for raising and lowering said soil-embedment depressor assembly, and sled pontoons equipped with sufficient additional ballast to provide sufficient negative buoyancy to offset the upward pressures of soil resistance, drawn forward by separate winch tension, said pontoons capable of safely channeling said cable-like member downward through said soil embedment depressor assembly for safe and undamaged embedment within the water bottom soils and soft rock, while remotely reporting and recording the depth of embedment.

33. The apparatus of claim 1 wherein said rock-embedment depressor assembly, attached to said adjustable-depth soil-embedment depressor assembly with both said assemblies in operation, is adapted to safely channel said cable-like member downward through said depressors for safe and undamaged embedment of said cable-like member within the water bottom rock and/or soils, while remotely reporting and recording the depth of embedment.

* * * * *

UNITED STATES PATENT AND TRADEMARK OFFICE

CERTIFICATE OF CORRECTION

PATENT NO. : 4,812,079

DATED : March 14, 1989

INVENTOR(S) : HARRY JOHNSON and RALPH M. WARE

It is certified that error appears in the above-identified patent and that said Letters Patent is hereby corrected as shown below:

Column 1, line 38, "fricton" should be --friction--.

Column 2, line 3, "embedment" should be --embeddor--.

Column 2, line 18, "embodiment" should be --embedment--.

Column 2, line 65, "beig" should be --being--.

Column 3, line 22, "ar ea" should be --are a--.

Claim 7, column 5, line 32, --to be achieved.-- should be added after "is".

Claim 15, column 5, line 68, "tungsten carbide" should be --tungsten-carbide--.

Claim 22, column 6, line 37, "f rom" should be --from--.

Claim 30, column 7, lines 11-12, "embedoor" should be --embeddor--.

Signed and Sealed this

Seventh Day of November, 1989

*Attest:*

JEFFREY M. SAMUELS

*Attesting Officer* *Acting Commissioner of Patents and Trademarks*